United States Patent [19]

Cornell

[11] Patent Number: 4,579,268

[45] Date of Patent: Apr. 1, 1986

[54] DISPENSER FOR COILED MATERIAL HAVING CONVERTABILITY BETWEEN LEVER AND CRANK OPERATIONS

[75] Inventor: Robert W. Cornell, Menomonee Falls, Wis.

[73] Assignee: Wisconsin Tissue Mills, Inc., Neenah, Wis.

[21] Appl. No.: 669,118

[22] Filed: Nov. 7, 1984

[51] Int. Cl.[4] ..... B65H 20/02

[52] U.S. Cl. ..... 226/101; 226/168

[58] Field of Search ..... 242/55.3, 55.53, 96; 312/38–40; 226/101, 129, 168, 181, 182

[56] References Cited

U.S. PATENT DOCUMENTS

| | | | |
|---|---|---|---|
| 2,947,493 | 8/1960 | Schneider et al. | 242/96 |
| 3,007,650 | 11/1961 | Burton | 242/55.3 |
| 3,044,732 | 7/1962 | Simonds | 242/96 |
| 3,140,060 | 7/1964 | Layton et al. | 242/55.53 |
| 3,628,743 | 12/1971 | Bastian | 242/55.3 |
| 3,672,552 | 6/1972 | Krueger et al. | 226/129 |
| 3,917,191 | 11/1975 | Graham, Jr. et al. | 242/55.3 |
| 4,010,909 | 3/1977 | Bastian | 242/55.3 |
| 4,067,509 | 10/1978 | Graham, Jr. et al. | 242/55.3 |
| 4,165,138 | 8/1979 | Hedge et al. | 312/39 |
| 4,251,038 | 2/1981 | Gename | 242/86 |
| 4,358,169 | 11/1982 | Filipowicz et al. | 312/39 |
| 4,386,621 | 6/1983 | Redl | 135/20 M |
| 4,403,748 | 9/1983 | Cornell | 242/55.53 |

FOREIGN PATENT DOCUMENTS 165354 6/1921 United Kingdom .

*Primary Examiner*—Leonard D. Christian

*Attorney, Agent, or Firm*—Andrus, Sceales, Starke & Sawall

[57] ABSTRACT

A dispenser for coiled sheet material which can be operated either through lever action or by a rotatable crank without modification of the dispenser. The dispenser includes a pair of cooperating feed rolls, one of which is a drive roll having a drive shaft. A gear is connected to the drive shaft through a one-way clutch mechanism and a gear segment, which is pivotally connected to the frame of the dispenser, is engaged with the gear. Connected integrally with the gear segment is a lever having a removable knob or handle which extends outwardly through the cabinet of the dispenser. By pushing downwardly on the handle the lever and gear segment will be pivoted to thereby rotate the gear and drive the feed rolls to dispense a length of sheet material. After dispensing, the lever is biased upwardly to its original position by a torsion spring. To convert to a crank mode of operation, the handle is removed from the end of the lever, enabling the biasing mechanism to urge the lever to a further upward position where it will move the gear segment out of contact with the gear, thereby disabling the lever mode of operation. A crank arm can then be removably secured to the end of the shaft, so that rotation of the crank will dispense a continuous length of sheet material.

7 Claims, 5 Drawing Figures

DISPENSER FOR COILED MATERIAL HAVING CONVERTABILITY BETWEEN LEVER AND CRANK OPERATIONS

BACKGROUND OF THE INVENTION

Paper towel dispensers contain a roll of toweling which is fed from the dispenser through a discharge opening by operation of a pair of cooperating feed rolls. In one form of conventional dispenser, the feed rolls are operated by a lever or handle which extends outwardly from the front of the cabinet. Downward movement of the lever will operate through a linkage to rotate the feed rolls and dispense a given length of sheet material through the discharge opening. A spring or other biasing mechanism is associated with the lever to return the lever to its original upper positon.

A second form of dispenser utilizes a small crank located on the side of the cabinet which is operably connected to one of the feed rolls. Rotation of the crank will operate the feed rolls to dispense a continuous length of toweling. Both the lever operated and crank operated dispensers are designed for a single type of operation, meaning that the dispenser cannot be converted from one manner of operation to the other without extensive modification of the drive mechanism. No dispensers have been available in which the operator, in the field, can readily convert from a lever mode of operation to a crank mode.

SUMMARY OF THE INVENTION

The invention relates to a dispenser for coiled sheet material which can be operated either through lever action or by a rotatable crank without modification of the dispenser. The dispenser includes a pair of cooperating feed rolls, one of which is a drive roll having a drive shaft, and a pinion is connected to the drive shaft through a one-way clutch. The clutch transmits rotation of the pinion in one direction to the drive shaft to thereby operate the feed rolls, while rotation of the pinion in the opposite direction will not be transmitted to the drive shaft.

A gear segment, which is pivotally connected to the frame of the dispenser, is engaged with the pinion, and a lever is integrally connected to the gear segment and extends outwardly through an opening in the cabinet. A knob or handle is removably connected to the end of the lever and by pushing the handle downwardly the lever and gear segment will pivot to thereby rotate the pinion and operate the feed rolls to dispense a given length of toweling or sheet material. Release of the handle will cause the lever to return upwardly to its original position under the influence of a biasing member which can take the form of a torsion spring.

Upward pivotal movement of the lever is limited by a stop mounted on the frame which is engaged by the handle.

When it is desired to convert from the lever mode of operation to the crank mode, the handle is removed from the end of the lever and the biasing means will urge the lever upwardly beyond the stop and correspondingly pivot the gear segment out of engagement with the gear to thereby disable the lever mode of operation. The crank can then be removably secured to a collar which is connected to the pinion. Rotation of the crank will then operate through the pinion to rotate the drive shaft and operate the feed rolls.

To re-establish the lever mode of operation, the crank is removed and the lever is pivoted downwardly to a level beneath the stop and the handle reassembled with the end of the lever. The handle will then engage the stop to maintain the gear segment in engagement with the pinion. As previously described, depressing the handle will then operate through the gear segment to rotate the pinion and operate the feed rolls.

With the mechanism of the invention, the dispenser can be readily converted in the field between lever and crank modes of operation. No special tools are required to convert the mode of operation, nor are any auxiliary parts required. The conversion can be made by removing either the lever handle or the crank and replacing the other part.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
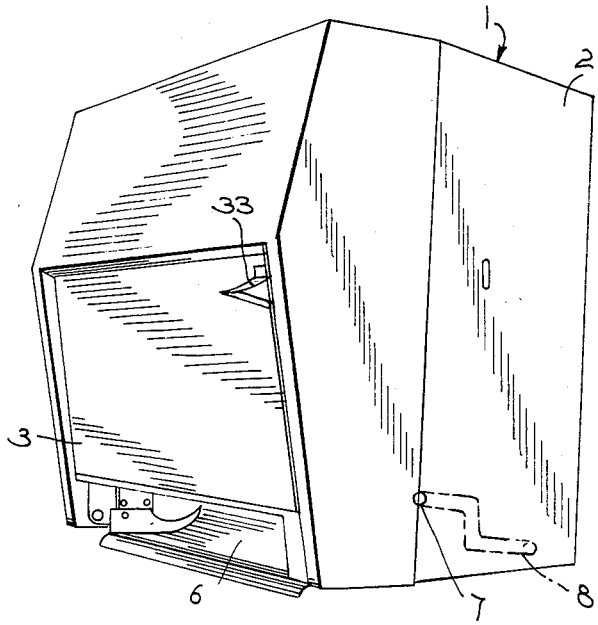
FIG. 1 is a perspective view of a dispenser utilizing a lever mode of operation.

FIG. 1 illustrates a dispenser 1 for rolled products, such as paper toweling, toilet tissue, or the like, which includes an outer cabinet or housing 2 and a front cover 3 which is hinged along its lower edge to the cabinet 2. An operating lever assembly 4 extends outwardly through a slot 5 in the front cover 3, and by pushing downwardly on the lever, a predetermined length of toweling or other sheet material will be dispensed from the dispenser through a lower discharge opening 6.

Located in the side of the cabinet 2 is an opening 7, and in the crank mode of operation, a crank 8 is engaged with the drive mechanism and rotation of the crank 8 will operate to dispense a continuous length of toweling through the discharge opening 6.

Figure 2:
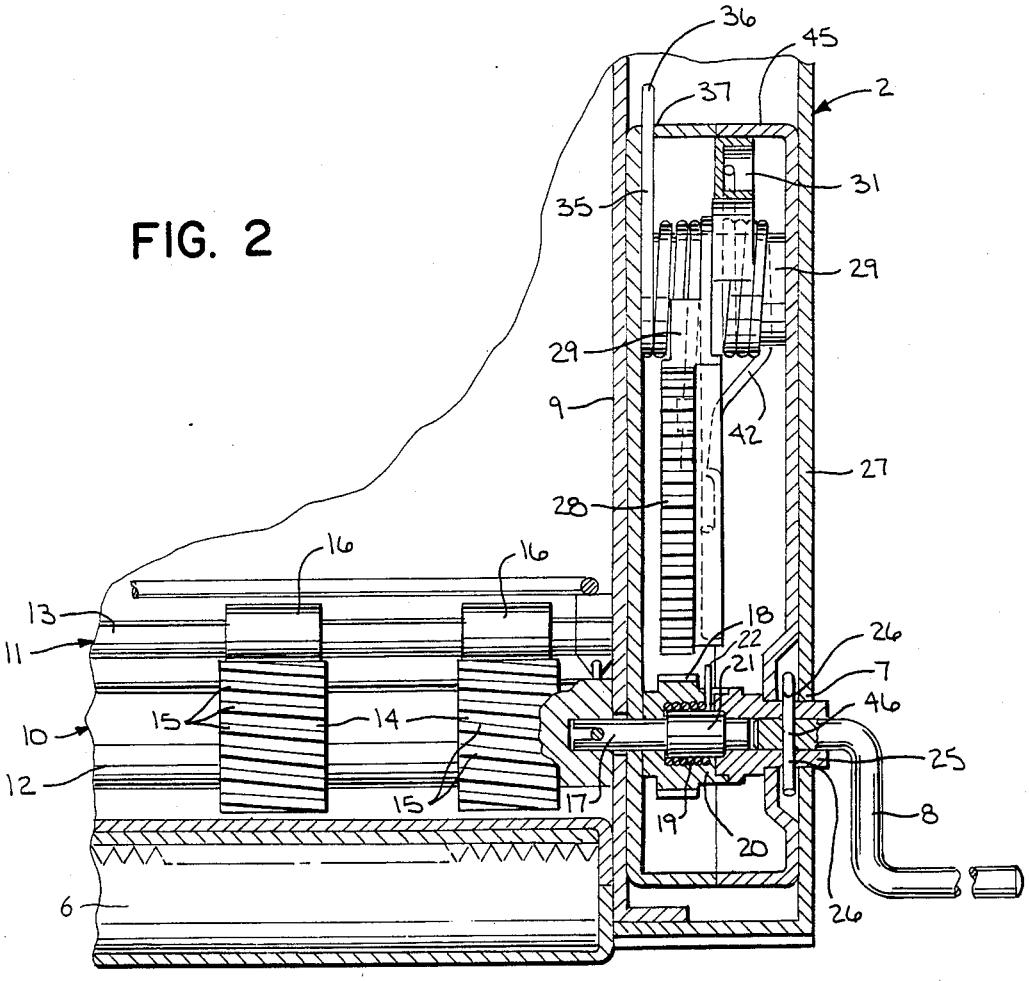
FIG. 2 is a vertical selection showing the feed rolls and the drive means.

The dispenser 1 includes an internal frame 9 and a drive roll 10 and pressure roll 11 are journaled in the frame 9. As illustrated in FIG. 2, the shaft 12 or drive roll 10 and the shaft 13 of pressure roll 11 are mounted for rotation with respect to the walls of frame 9.

The construction of the feed roll 10 and pressure roll 11 can be similar to that disclosed in the U.S. Pat. No. 4,403,748. As shown in FIG. 2, a series of resilient collars 14 are mounted in spaced relation along the length of the feed roll 10 and collars 14 have diagonally extending ribs 15, as described in the aforementioned patent. Collars 16 are formed on pressure roll 11 and are aligned with collars 14, and the toweling or other sheet material is fed between the cooperating collars 14 and 16 on rolls 10 and 11 as described in the aforementioned patent.

Pressure roll 11 is biased downwardly into engagement with the feed roll 10 by a spring mechanism as described in the aforementioned patent.

Figure 3:
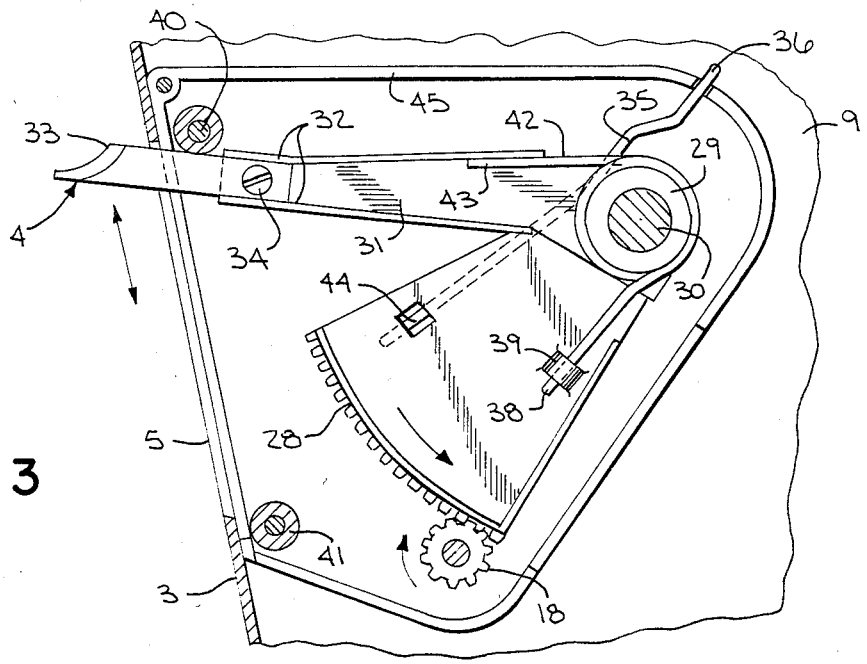
FIG. 3 is a side elevation of the drive mechanism in the lever mode of operation.
Figure 5:
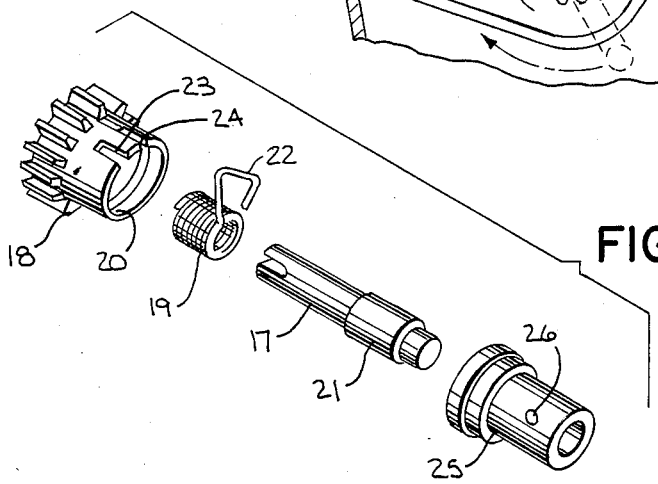
FIG. 5 is an exploded view of the drive shaft and one-way clutch mechanism.

In accordance with the invention, the feed roll 10 is operated either through use of lever assembly 4 or crank 8, and FIGS. 1 and 3 illustrate the lever mode of operation. The drive mechanism for rotating the feed roll 10 includes a shaft extension 17 which is connected to the end of shaft 12 of feed roll 10 and extends outwardly through the side wall of frame 9. A pinion 18 is connected to shaft extension 17 through a one-way clutch mechanism 19 which, as shown in the drawings, is in the form of a helically wound spring. As best shown in FIG. 2, the spring clutch 19 is mounted within a cavity 20 in pinion 18 and is disposed around an enlarged portion 21 of shaft extension 17. One end 22 of the spring clutch extends outwardly and is received within a pair of slots 23 and 24 provided in pinion 18, best shown in FIG. 5. With this construction, rotation of the pinion 18 in one direction will act to wind the spring on enlargement 21 to thereby transmit the pinion rotation to the shaft extension 17 and feed roll 10, while rotation of the pinion 18 in the opposite direction will not be transmitted to the shaft extension, so that the pinion will free-wheel on the shaft extension.

A tubular cap 25 is secured to the outer end of pinion 18, and the outer end of cap 25 is provided with a pair of aligned holes 26 which are utilized in attaching the crank 8 as will hereinafter be described.

The drive mechanism for rotating the feed roll 10 is housed within the side wall 27 of cabinet 2, as well shown in FIG. 2.

In the lever mode of operation, a gear segment 28, having a series of teeth engaged with the teeth on pinion 18, serves to rotate the pinion 18 and thereby operate the feed roll 10. As best shown in FIG. 3, the gear segment is provided with a hub 29 which is pivoted about a shaft 30 attached to side wall of frame 9. One end of a lever 31 is also pivoted on hub 29 and operates in unison with the gear segment 28. As shown in FIG. 3, the outer portion of lever 31 is provided with a pair of spaced side flanges 32 and a knob or handle 33 is secured between the side flanges by a screw 34. Handle 33 projects outwardly through the slot 5 in the front cover 3 of the cabinet.

With this construction, downward movement of handle 33 will pivot the lever 31 and gear segment 28 counterclockwise, as shown in FIG. 3, thereby rotating the pinion 18 and correspondingly operating the feed roll 10 to dispense a given length of toweling from opening 6 in the cabinet. A roll of toweling, not shown, is mounted in the upper portion of the cabinet and can be fed to the cooperating rolls 10 and 11 by a mechanism as described in U.S. Pat. No. 4,403,748.

Lever 31 and gear segment 28 are biased in a clockwise direction, as shown in FIG. 3, by a torsion spring 35. One end 36 of spring 35 extends through a hole 37 in the flange of the side wall of frame 9, while the opposite end 38 of spring 35 is engaged with an ear 39 formed on gear segment 28. The force of torsion spring 35 will urge the lever 31 and gear segment 28 clockwise, as shown in FIG. 3, to thereby return the handle to its original position after the dispensing operation. Pivotal movement of the knob 33 is limited by a pair of stops 40 and 41 which extend outwardly from the sidewall of frame 9. Upper stop 40 limits the upward pivotal movement of the handle under the influence of the biasing spring 35, while lower stop 41 will limit the downward movement of the handle during the dispensing operation and thus control the length of the toweling being dispensed.

An overload protection spring 42 is also associated with the lever 31 and gear segment 28. As shown in FIG. 2, one end 43 of spring 42 is engaged with the upper side flange 32 of lever 31, while the opposite end 44 of spring 42 is engaged with a keeper on the gear segment 28. Spring 42 serves to connect the lever and the gear segment so that under normal operation, pivotal movement of the lever will result in corresponding pivotal movement of the gear segment. However, in the event that the feed roll is jammed and cannot rotate, downward pressure on handle 33 will act against the torsion spring 42 to pivot lever 31 relative to gear segment 28 to thereby prevent breakage of the drive mechanism.

Figure 4:
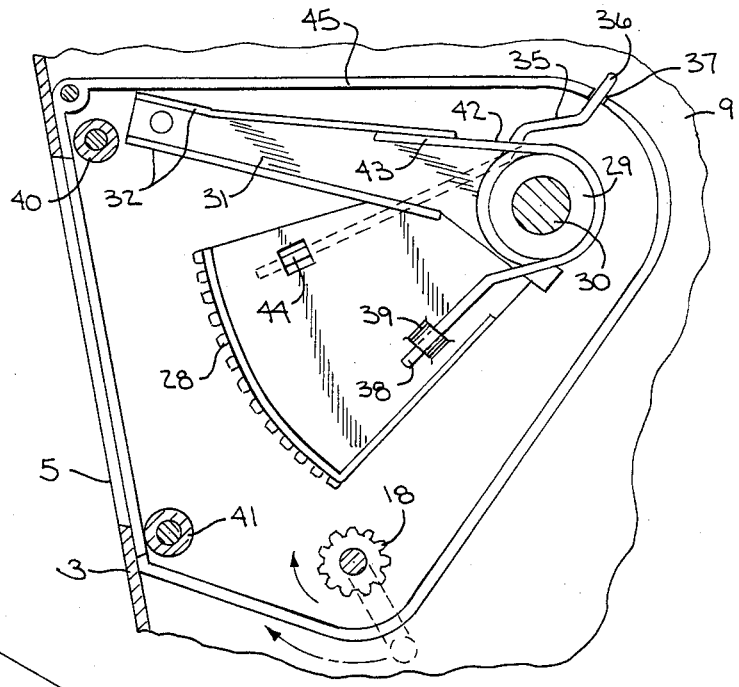
FIG. 4 is a view similar to FIG. 3 showing the crank mode of operation.

As previously described, FIGS. 1 and 3 show the lever mode of operation. If it is desired to convert to the crank mode of operation in the field, screw 34 is removed to thereby disconnect the handle 33 from lever 31. The biasing spring 35 will then urge lever 31 and gear segment further upward to a location where the end of the lever will engage the upper flange 45 on the side wall 13. In this position the teeth on gear segment 28 will be disengaged from the teeth of the drive pinion 18, as shown in FIG. 4, so that the lever mode of operation is completely disabled.

The crank 8 is then inserted through the opening 7 in the cabinet and connected to the cap 25 by a cotter pin 46, or the like. With the crank 8 connected, rotation of the crank will operate through the one-way clutch 19 to drive the feed roll 10 and dispense a continuous length of toweling from the cabinet.

To reestablish the lever mode of operation, the crank 8 is disengaged from cap 25 by removal of pin 46 and lever 31 is pivoted downwardly to a level beneath stop 40, thereby re-engaging the teeth of gear segment 28 with the teeth of pinion 18. Handle 33 is then reengaged with the end of the lever 31 through screw 34. When released, handle 33 will then engage the upper stop 40 preventing the lever 31 and gear segment 28 from moving to their full upper position and thus maintaining the teeth of the gear segment 28 in engagement with the teeth of pinion 18.

The invention enables the dispenser to be readily converted between a lever mode of operation and a crank mode of operation. No special tools are required for the conversion and no auxiliary parts are necessary. The operator in the field merely removes either the lever handle or the crank and replaces the other to convert the dispensing operation.

Various modes of carrying out the invention are contemplated as being within the scope of the following claims particularly pointing out and distinctly claiming the subject matter which is regarded as the invention.

I claim:

1. A dispenser for coiled sheet material, comprising a supporting structure, a pair of cooperating rolls journalled in said supporting structure, one of said rolls being a feed roll and having drive shaft means, an operating handle, drive means interconnecting the handle with said shaft means in a manner so that movement of said handle in one direction will rotate said shaft means to drive said feed roll and feed a length of sheet material from said dispenser, means for releasably connecting a crank to said shaft means, and drive disengaging means operable as a consequence of disengaging the handle from the drive means for effecting disengagement of the drive means from said shaft means, whereby operation of said crank will drive said feed roll to dispense sheet material from said dispenser.

2. The dispenser of claim 1, wherein said shaft means includes one-way clutch means, whereby rotation of said drive means in one direction will be transmitted through said one-way clutch means to said shaft means while rotation of said drive means in said opposite direction will not be transmitted to said shaft means.

3. The dispenser of claim 1, and including biasing means for urging said handle in the opposite direction.

4. The dispenser of claim 1, wherein said drive means comprises a lever removably attached to said handle and mounted for pivotal movement with respect to said supporting structure, said drive means also including a gear segment connected to said lever and pivotable therewith, and a gear mounted on said shaft means and engaged with said gear segment, movement of said hangle in said one direction pivoting said lever and said gear segment to thereby rotate said gear and said shaft means.

5. The dispenser of claim 4, and including biasing means for urging said handle in the opposite direction.

6. A dispenser for coiled sheet material that can be converted between lever operation and crank operation, comprising a frame, a pair of cooperating rolls to feed sheet material, with one of said rolls being a feed roll and having drive shaft means, a gear mounted on said shaft means, a gear segment pivotally connected to the frame and engaged with said gear, a lever pivotally connected to the frame and movable in unison with said gear segment, a handle removably connected to the outer end of said lever and extending outwardly of the frame of said dispenser, movement of said handle in one direction serving to pivot said lever and said gear segment to thereby rotate said gear and said shaft means to operate said feed roll, biasing means operably connected to said lever for urging the handle in said opposite direction, a first stop mounted on the frame to be engaged by said handle to limit pivotal movement under the influence of said biasing means, a second stop connected to the frame to be engaged by said lever to limit pivotal movement of said lever under the influence of said biasing means when the handle is disengaged from the lever, said first and second stops being arranged with respect to said gear segment such that movement of said lever into engagement with said second stop on removal of said handle will disengage said gear segment from said gear to thereby disable said lever mode of operation, and means for removably connecting a crank to said shaft means.

7. The dispenser of claim 6, and including one-way clutch means interconnected between said gear and said shaft means, said clutch means transmitting rotation of the gear in one direction to said shaft means and not transmitting rotation of the gear in the opposite direction to said shaft means.

* * * * *